US006824007B2

(12) United States Patent
Timmers et al.

(10) Patent No.: US 6,824,007 B2
(45) Date of Patent: Nov. 30, 2004

(54) CURL LIMITING NAPKIN DISPENSER

(75) Inventors: James K. Timmers, Menasha, WI (US); Chester W. Gooding, Jr., Neenah, WI (US); Daniel J. Geddes, Appleton, WI (US)

(73) Assignee: Fort James Corporation, Atlanta, GA (US)

( * ) Notice: Subject to any disclaimer, the term of this patent is extended or adjusted under 35 U.S.C. 154(b) by 85 days.

(21) Appl. No.: 10/195,356

(22) Filed: Jul. 15, 2002

(65) Prior Publication Data

US 2003/0019880 A1 Jan. 30, 2003

Related U.S. Application Data

(60) Provisional application No. 60/307,676, filed on Jul. 25, 2001.

(51) Int. Cl.[7] ..... A47K 10/24

(52) U.S. Cl. ..... 221/53; 221/56; 221/59; 221/52; 221/55; 221/63; 221/47; 221/48

(58) Field of Search ..... 221/47, 48, 53, 221/55, 63, 52, 56, 59, 57

(56) References Cited

U.S. PATENT DOCUMENTS

| | | | | | |
|---|---|---|---|---|---|
| 1,682,580 | A | | 8/1928 | Pratt | |
| 1,930,805 | A | | 8/1930 | Hope | 312/61 |
| 1,993,885 | A | | 3/1935 | Horwitt | 312/61 |
| 2,027,671 | A | * | 1/1936 | Broeren | 221/59 |
| 2,426,136 | A | | 8/1947 | Agamaite, Jr. | 312/62 |
| 2,852,158 | A | | 9/1958 | Jones et al. | 221/35 |
| 3,203,586 | A | | 8/1965 | Downham | 221/55 |
| 4,065,028 | A | | 12/1977 | Merila | 221/36 |
| 4,094,442 | A | | 6/1978 | Radek | 221/59 |
| 4,311,252 | A | | 1/1982 | Hope, Jr. et al. | 221/57 |
| 4,329,001 | A | | 5/1982 | Filipowicz et al. | 312/71 |
| 4,343,415 | A | | 8/1982 | Radek | 221/59 |
| 4,679,703 | A | | 7/1987 | De Luca | 221/52 |
| 4,768,679 | A | * | 9/1988 | Matsui | 221/48 |
| 4,838,454 | A | | 6/1989 | Salzmann et al. | 221/57 |
| 4,921,127 | A | * | 5/1990 | Windorski | 221/45 |
| 4,953,747 | A | * | 9/1990 | Wenkman et al. | 221/45 |
| 5,076,466 | A | | 12/1991 | Petterson et al. | 221/46 |
| 5,131,561 | A | * | 7/1992 | Casperson et al. | 221/35 |
| 5,143,250 | A | * | 9/1992 | Freitag | 221/59 |
| 5,931,339 | A | | 8/1999 | Dodge et al. | 221/45 |
| 5,950,863 | A | | 9/1999 | Schutz et al. | 221/46 |
| 6,003,723 | A | | 12/1999 | Morand | 221/44 |
| D430,764 | S | | 9/2000 | Conran et al. | D6/518 |
| 6,286,713 | B1 | * | 9/2001 | Chan et al. | 221/49 |
| 6,334,544 | B1 | * | 1/2002 | Christensen et al. | 221/63 |
| 6,575,329 | B2 | * | 6/2003 | Clark | 221/45 |
| 6,585,129 | B2 | * | 7/2003 | Moody et al. | 221/44 |

FOREIGN PATENT DOCUMENTS

| | | | |
|---|---|---|---|
| WO | WO 97/09918 | 3/1997 | A47K/10/42 |
| WO | WO 98/22009 | 5/1998 | A47K/10/42 |

* cited by examiner

*Primary Examiner*—Donald P. Walsh
*Assistant Examiner*—Matthew J. Kohner
(74) *Attorney, Agent, or Firm*—Michael W. Ferrell

(57) ABSTRACT

A curl reducing adapter kit for a napkin dispenser used for dispensing interfolded napkins including an enclosure with a dispensing wall defining a dispensing slot and a slidably mounted, biased pressure carriage adapted to advance a stack of napkins in the enclosure toward the dispensing wall includes a tongue for mounting about the dispensing wall such that the tongue projects into the dispensing slot and narrows the slot. The tongue further includes a plurality of friction tabs configured to project inwardly into the enclosure from the upper inner lip of the dispensing slot and frictionally engage the napkins to limit bulge through the slot. A plurality of orienting ridges are configured to be disposed about a lower portion of the dispensing wall and are adapted to frictionally engage the napkin stack to guide the stack and reduce curl while a plurality of curl limiting tabs are configured to be disposed about the lower inner lip of the dispensing slot and project inwardly into the enclosure so as to frictionally engage the stack of napkins and further limit curl. A napkin dispenser having the foregoing features may likewise be constructed incorporating the features without the need for an adapter kit.

65 Claims, 7 Drawing Sheets

CURL LIMITING NAPKIN DISPENSER

CROSS-REFERENCE TO RELATED APPLICATIONS

This application is based upon U.S. Provisional Application Ser. No. 60/307,676, of the same title, filed Jul. 25, 2001, the priority of which is hereby claimed. This application is also related in subject matter to application Ser. No. 09/812,495 entitled Napkin Dispenser for Interfolded Napkins with Baffled Dispensing Aperture filed Mar. 20, 2001, now U.S. Pat. No. 6,585,129.

TECHNICAL FIELD

The present invention is directed to napkin dispensers generally, and more particularly to a dispenser for receiving interfolded napkins and dispensing them while reducing the tendency of the napkins to curl about an edge thereof.

BACKGROUND

Spring biased napkin dispensers are well known in the art. An early example appears in U.S. Pat. No. 1,682,580 to Pratt. In the '580 patent there is provided a napkin dispenser including a casing and a pressure carriage to urge the stack of napkins towards the face or dispensing plate. In U.S. Pat. No. 1,930,805 to Hope there is disclosed a napkin dispenser including a container adapted to receive a stack of napkins which are urged toward the dispensing aperture by way of a follower attached to a leaf spring. Still yet another example of a napkin dispenser appears in U.S. Pat. No. 1,993,885 to Horwilt. The device of the '885 patent includes a face plate that is outwardly bulged or obliquely offset to afford a pocket like extension of progressively increasing depth from the bottom to the top which arrangement defines a transverse slot of relatively small width.

In U.S. Pat. No. 2,426,136 to Agamaite, Jr. there is disclosed a napkin dispenser having a lid which may be opened for replenishing the napkins and a latch controlled by the lid to hold a follower in retracted position while the napkins are being replenished.

U.S. Pat. No. 2,852,158 to Jones et al. discloses a napkin dispenser provided with a pair of spaced pusher plates attached to the free ends of a U-shaped spring which urges napkins towards a dispensing aperture.

Of more recent vintage is U.S. Pat. No. 4,329,001 to Filipowicz et al wherein there is disclosed a dispenser for folded paper napkins including a cabinet with a carriage assembly. A pair of constant force springs are affixed to the cabinet and engage the rear of the pressure plate to urge the plate and carriage assembly forwardly against the rear of the napkin supply to facilitate individual removal of the napkins through the cabinet opening.

In U.S. Pat. No. 4,679,703 to De Luca there is disclosed a napkin dispenser including means for preventing napkins from bunching at the dispensing opening. A pair of pressure relief rods are provided along the upper and lower portions of the dispenser face plate to relieve pressure between the face plate and the center portion of the napkin stack. According to the '703 patent the friction between each napkin is substantially reduced thereby permitting individual napkins to be withdrawn from the dispenser without displacing napkins remaining in the stack.

U.S. Pat. No. 4,838,454 to Salzmann et al. discloses a napkin dispenser including a drawer which slides in and out of a housing and a push plate which also slides in the housing and a spring to the push napkins forward. A pair of locks on the rear of the drawer in the napkin dispenser push the plate forward when the drawer is open but pivot to release the push plate when the drawer is closed so that the napkins are not pressed too tightly, even if napkins are overloaded into the drawer when it is open.

U.S. Pat. No. 5,076,466 to Petterson et al. shows a napkin dispenser with anti-overfill mechanism. Generally speaking the dispenser includes a housing, a support member movably mounted within the housing and a follower for urging the stack in the direction of a dispenser element included in the support member. The apparatus includes a mechanism for engaging the follower and retaining it at a predetermined location relative to the support member when the support member is in open condition which is disengaged in the follower when the support member moves to its closed position to compensate for any over filling of the dispenser.

The foregoing patents (the disclosures of which are incorporated herein by reference) may be distinguished from gravity feed devices of the class generally employed to dispense heavier weight paper towels for example, as are shown in U.S. Pat. No. 5,950,863 to Schutz et al. by virtue of the fact that a spring biased device operates quite differently than a gravity feed device and does not rely primarily on the weight of the stack for delivery of product to the dispensing aperture.

In existing dispensers for napkins, when an interfolded napkin is dispensed it is often found that a tightly curled portion is formed at one end of the napkin in every other napkin in a stack of single fold napkins, particularly when the napkin is dispensed through a slot located away from the centerline of the napkin stack. This curl not only hinders proper use of the napkin by reducing the napkin's overall size, but is also aesthetically unattractive. It has been discovered in accordance with the present invention that this curl is induced in the napkin during the dispensing operation by interaction between napkins in the stack with each other and the dispenser. This phenomenon seems to be somewhat more pronounced when baffles are used to limit the ease of withdrawal of multiple napkins. The invention which is described in detail hereinafter is directed to reducing and most preferably substantially eliminating the curl associated with dispensing a stack of interfolded napkins. Other advantages of the invention include promoting the distribution of a single napkin at a time and controlling the tendency of napkins to bunch about the dispensing slot or aperture.

SUMMARY OF INVENTION

A curl reducing adapter kit is provided for a napkin dispenser used for dispensing interfolded napkins. The dispenser generally includes an enclosure provided with a dispensing wall defining a horizontal dispensing slot about its upper portion and a slidably mounted, biased pressure carriage adapted to advance a stack of napkins in the enclosure toward the dispensing wall. The kit includes a tongue for mounting about the dispensing wall such that the tongue projects into the dispensing slot and narrows the slot, about its central portion in one preferred embodiment. The tongue includes a plurality of friction tabs configured to project inwardly into the enclosure from the upper inner lip of the modified dispensing slot and frictionally engage the napkins to limit bulge through the slot. A plurality of orienting ridges configured to be disposed about a lower portion of the dispensing wall adapted to frictionally engage the napkin stack are provided to guide napkins toward the dispensing aperture and reduce curl. A plurality of curl limiting tabs configured to be disposed about the lower inner lip of the dispensing slot also project inwardly into the enclosure so as to frictionally engage the stack of napkins and further discourage curl. In a typical embodiment, there is further provided a pressure plate for mounting on the pressure carriage in opposed facing relationship to the dispensing wall, the pressure plate having a pressure rib on its upper portion which is configured to project towards the dispensing wall closer than the lower portion of the pressure plate in opposed facing relationship to said dispensing wall. In such embodiments, the pressure rib of the pressure plate is configured to project a distance of from about ½ inch to about 1 inch closer to the dispensing wall then the lower surface of the pressure plate in opposed facing relationship to the dispensing wall. The kit also limits the number of napkins which can be dispensed in a single grasping motion.

In one embodiment, the tongue is preferably configured to define a narrow elongated slit about the central portion of the dispensing slot as well as to define a pair of open areas about the terminal portions thereof. Typically, the terminal portions have an open area span of at least about ½ inch and more characteristically, the terminal portions have an open area span of at least about ⅓ inch or sometimes at least about 1 inch. If so desired, the tongue can be configured to define an open area in the central region of the dispensing aperture. The narrowed portions of the dispensing slot generally spans more than about 50 percent of the transverse dimension of an interfolded napkin being dispensed therethrough and usually spans more than about 70 percent of the transverse dimension of an interfolded napkin being dispensed therethrough. The tongue is generally configured to define the narrow portion of the dispensing slot to have an opening width of from about 1/16 inch to about ⅞ inch whereas an opening width of from about ⅛ inch to about ⅞ inch is more typical and an opening width about the narrow portion of the dispensing slot of from about ⅜ inch to about ⅝ inch is preferred.

In a preferred embodiment, the plurality of friction tabs on the tongue are generally semicircular disc-shaped (half circular) and have a diameter of from about ¼ inch to about ½ inch. The plurality of friction tabs on the tongue may include from about 6 to about 10 friction tabs and typically have a friction surface width of from about 1/16 inch to about ¼ inch.

The plurality of orienting ridges may include or consist of a plurality of triangular-shaped ribs which project progressively further into said enclosure toward the base of said dispensing wall as is shown in the drawings which are appended. The triangular orienting ridges usually project inwardly into the enclosure at their base a distance of from about ¼ inch to about 1 inch and have a friction surface of a width of from about 1/16 inch to about ¼ inch. While any suitable number of orienting ridges may be employed, about 4 to about 8 orienting ridges configured to be disposed about the lower portion of the dispensing wall is typical.

As noted above, the adapter kit further includes curl limiting tabs about the lower inner lip of the dispensing slot which are generally semicircular disc-shaped tabs in a preferred embodiment and have a diameter of from about ¼ inch to about ½ inch. From about 8 to about 12 curl limiting tabs is typical. These tabs may also have a friction surface width of from about 1/16 inch to about ¼ inch.

In another aspect of the invention, there is provided a napkin dispenser for dispensing a stack of interfolded napkins while reducing curling along edges thereof comprising an enclosure with a dispensing wall having upper and lower portions provided with an elongated dispensing aperture extending across the dispensing wall between the upper and lower portions thereof, the dispensing wall being further provided with a pressure exerting member projecting inwardly into the interior of the enclosure along an edge portion of one of the upper and lower portions of the dispensing wall. The napkin dispenser is further provided with a pressure carriage slidably mounted in the enclosure having a pressure plate in an opposed facing relationship to the dispensing wall, the pressure plate of the pressure carriage being provided with a pressure rib opposing the portion of the dispensing wall distal to the pressure exerting member of the dispensing wall. Biasing means such as a spring urge the pressure carriage towards the dispensing wall. The enclosure and pressure carriage are configured to receive a stack of interfolded napkins between the dispensing wall and the pressure plate of the pressure carriage, such that the napkins are engaged by the pressure exerting member of the dispensing wall and the pressure rib of the pressure plate and wherein the biasing means are operative to advance the stack of napkins toward the dispensing wall as napkins are withdrawn from the dispenser. So also, undesirable dispensing of multiple napkins in a single grasping motion is inhibited from the dispenser of the present invention.

In yet another aspect of the invention, there is provided a napkin dispenser for dispensing a stack of interfolded napkins while reducing curling along the edges thereof comprising: an enclosure with a dispensing wall provided with an elongated dispensing aperture extending across the dispensing wall dividing it into upper and lower portions, wherein the lower portion of the dispensing wall is larger than the upper portion of the dispensing wall and is further provided with a plurality of pressure exerting ribs extending inwardly into the enclosure from the lower portion of the dispensing wall, as well as a plurality of friction tabs about the upper edge of the dispensing aperture and a plurality of curl limiting tabs about the lower edge of the dispensing aperture, the tabs extending generally inwardly into the enclosure. A pressure carriage is slidably mounted in the enclosure and has a pressure plate in an opposed facing relationship to the dispensing wall, the pressure plate being provided with an upper pressure rib in opposed facing relationship to the upper portion of the dispensing wall and a lower portion in opposed facing relationship to the lower portion of the dispensing wall; and biasing means for urging the pressure carriage towards the dispensing wall. The enclosure and the pressure carriage are configured to receive the stack of interfolded napkins between the dispensing wall and the pressure plate of the pressure carriage such that the napkins are engaged by the plurality of pressure exerting ribs of the dispensing wall, the plurality of friction tabs and curl limiting tabs of the dispensing wall and the pressure rib of the pressure carriage and wherein the biasing means operate to advance the stack of interfolded napkins toward the dispensing wall as napkins are withdrawn from the dispensing aperture.

In a still yet further aspect of the invention there is provided a napkin dispenser for dispensing a stack of interfolded napkins including: an enclosure including a dispensing wall defining generally a narrow elongated dispensing aperture with at least one open area over a portion of the dispensing aperture; a pressure carriage slidably mounted in the enclosure provided with a pressure plate in opposed facing relationship to the dispensing wall; a plurality of friction tabs about the first inner lip of the dispensing aperture projecting inwardly into the enclosure towards the pressure plate of the pressure carriage for engaging the napkins; a plurality of curl limiting tabs about the second inner lip of the dispensing aperture projecting inwardly into the enclosure towards the pressure plate of the pressure carriage for engaging the napkins; and biasing means for urging the pressure carriage towards the dispensing wall. The enclosure, pressure carriage and dispensing wall are thereby adapted and configured to receive a stack of interfolded napkins between the pressure plate of the pressure carriage and the dispensing wall and advance the stack towards the dispensing wall as the napkins are withdrawn from the dispenser. The inventive adapter and dispensers so configured are especially suitable for dispensing a stack of single fold napkins one at a time or seriatim.

BRIEF DESCRIPTION OF DRAWINGS

The invention is described in detail below with reference to the various figures in which.

In the various figures, like parts of the same embodiment of the present invention are designated by the same numerals.

DETAILED DESCRIPTION

Figure 1A:
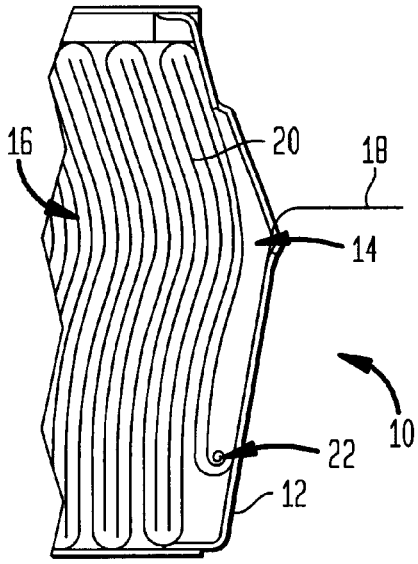
FIG. 1A (PRIOR ART)
FIG. 1A is a schematic diagram illustrating the dispensing of single fold napkins wherein an edge of a napkin is provided with undesirable curl.

When napkins are dispensed in the conventional dispensers found in most quick service restaurants, not only it is very easy for the consumer to withdraw several napkins at the same time, it is in fact often difficult for the consumer to withdraw less than several napkins at the same time especially as the dispensers tend to be overloaded prior to the busy hours of service in the quick service restaurant causing numerous napkins to bunch and protrude through the opening or the middle of several napkins will protrude through the opening making it difficult for the consumer to grasp only one. One way that is being tried to address such problems has involved the use of interfolded napkins in dispensers having restrictor baffles so that as each napkin is withdrawn from the dispenser, (ideally) the edge of another napkin is presented to the consumer. However, dispensing interfolded napkins through narrow openings brings on a host of other problems.

Typically, conventional dispensers have a long horizontal slot about 6½ inches wide and about 1½ inches tall disposed on the face plate about 3 inches from the bottom of the dispenser and 1 inch from the top. We believe that many of the foregoing difficulties are caused by the fact that the opening in the dispensers is located asymmetrically in the face plate of the dispenser and away from the centerline of the stack of napkins. Often, when used with interfolded napkins, this kind of dispenser is bedeviled by curl induced in the adjacent napkins as the front most napkin is withdrawn through the slot. However, as quick service restaurants are already equipped with conventional dispensers there is a need for "adapter kits" which can be fitted into existing dispensers and overcome these present difficulties and allow the use of interfolded napkins.

There are numerous salient aspects to "adapter kits" used to implement the present invention: first, a restrictor plate or tongue means is fitted to the inside of the face plate of the dispenser, this restrictor plate has a tongue protruding into the opening in the face plate of the dispenser thereby narrowing it considerably in the center of the longitudinal opening extending across the face plate of the dispenser but leaving the dispenser opening at substantially full height at least one, preferably two of the terminal portions of the slot. Second, to cause the upper folded edges of napkins to be retained inside the dispenser cavity, bulge limiting or friction tabs protruding inwardly and generally perpendicularly from the restrictor plate thus by frictional forces reduce the tendency of the upper folded edge of the napkins from passing under the upper lip of the restrictor plate. In this manner it is ensured that the consumer is presented with the free edge of the napkins while also preventing an excessive length of napkin from protruding through the opening in an undesirable fashion and possibly being soiled by contact with the surface that the dispenser rests upon. Third, a lower orienting plate has bending and trapping ridges formed across its width which help cause a free tail of the next adjacent napkin to be retained within the fold of the napkin being withdrawn, while inducing a fold in that panel of the next adjacent napkin which is presented through the opening after the prior napkin is withdrawn. Fourth, curl limiting tabs along the lower edge of the opening help limit curl from being induced in the protruding panel of the napkin as it is drawn over the edge of the opening in the face plate. Fifth, by removing the lower rib extending across the back pressure plate in the napkin cavity of conventional dispensers, the net effect of adding the bending and trapping ridges and removing the lower rib in the back pressure plate is to urge the napkins towards the opening. These and other features of the present invention will be better appreciated from the discussion which follows. It should be noted that the adapter kit may be implemented in numerous embodiments, for example, it could include several distinct pieces as shown hereinafter or a unitary adapter plate for the front of the unit could be manufactured as will be readily apparent to one of skill in the art. Likewise, one could configure a napkin dispenser as shown in the drawings from initial manufacture rather than retro-fit existing dispensers with an adapter kit if so desired.

Figure 1B:
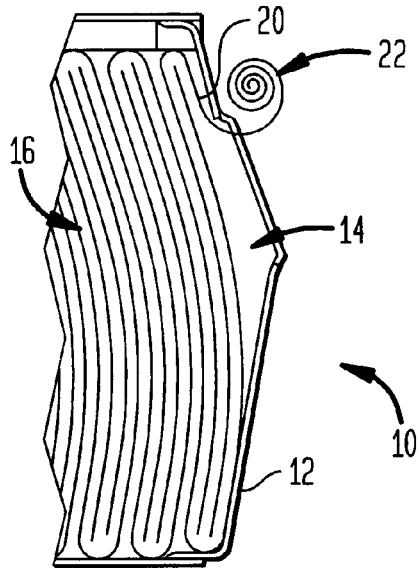
FIG. 1B (PRIOR ART)
FIG. 1B is a diagram showing a curled protruding edge of a single fold napkin from a conventional napkin dispenser resulting from the process illustrated schematically in FIG. 1A.

The present invention is perhaps better understood by consideration of FIGS. of 1A and 1B. FIGS. 1A and 1B are schematic illustrations of a conventional napkin dispenser dispensing a stack of single fold napkins. Such napkins are generally folded about a line of symmetry in their center portion and are provided in an interfolded stack that is described in more detail hereinafter.

Referring first to FIG. 1A, there is shown a napkin dispenser 10 provided with a dispensing wall 12. Dispensing wall 12 is provided with a dispensing aperture 14 which is generally an elongated horizontal slot as is known in the art. Inside a napkin dispenser 10 there is provided a stack of napkins 16 such as the stack of interfolded single fold napkins shown in FIG. 1A and FIG. 1B. The napkin stack is urged towards dispensing wall 12 by way of a spring biased pressure carriage as is described in more detail with connection with the embodiments of the invention.

During dispensing, a user withdraws a napkin such as napkin 18 by grasping its protruding edge from the exterior of the napkin dispenser and pulling napkin 18. The next adjacent napkin 20 in the stack has an edge 22 disposed in the fold of napkin 18. In a conventional dispenser, there is frequently a problem in that edge 22 of napkin 20 becomes curled as napkin 18 is withdrawn and edge 22 is pulled upwardly towards dispensing aperture 14 as is shown in FIG. 1A. As can be seen particularly in FIG. 1B, edge 22 exhibits a relatively permanent curl which is unsightly and reduces the effective size of the napkin dispensed to the consumer. In a typical prior art napkin dispenser, the phenomenon shown and described above in connection with FIGS. 1A and 1B frequently occurs with every other napkin in the stack. The present invention operates to reduce this problem and provide napkins without curl, or at least significantly reduced curl. Moreover, another problem encountered in the art is that conventional napkin dispensers frequently have an aperture which is too large or not optimal for dispensing a single napkin at a time or limiting bulge in a napkin stack, particularly when the dispenser is overfilled with product. In this regard, it is noted in the patents referred to above that dispensing too many napkins at a time or bunching about the dispensing aperture is a well recognized problem. The present invention, besides being directed to reducing the curl problem, is also directed towards configuring the dispensing aperture in a spring biased napkin dispenser so that it will neither release too much product in response to withdrawal of a single napkin, nor make it easy for consumers to withdraw multiple napkins in a single grasping operation.

Figure 5:
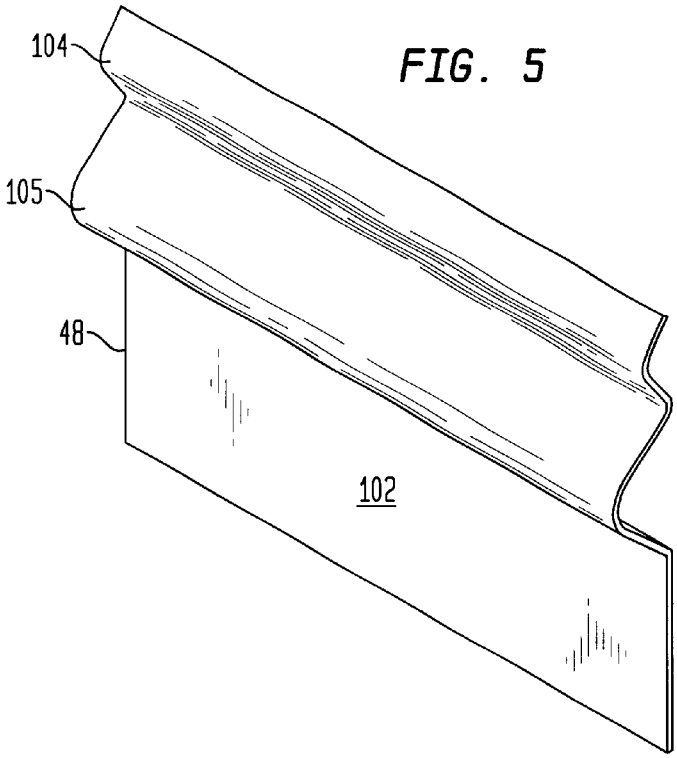
FIG. 5 is a view in perspective of a pressure plate of the adapter kit of the present invention.
Figure 6:
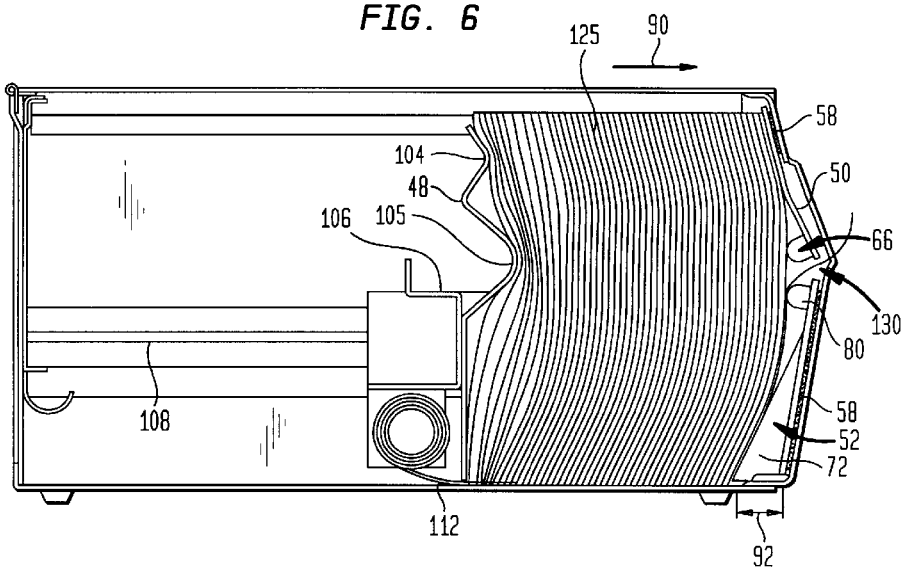
FIG. 6 is a view in elevation and section of a napkin dispenser configured in accordance with the present invention.
Figure 7:
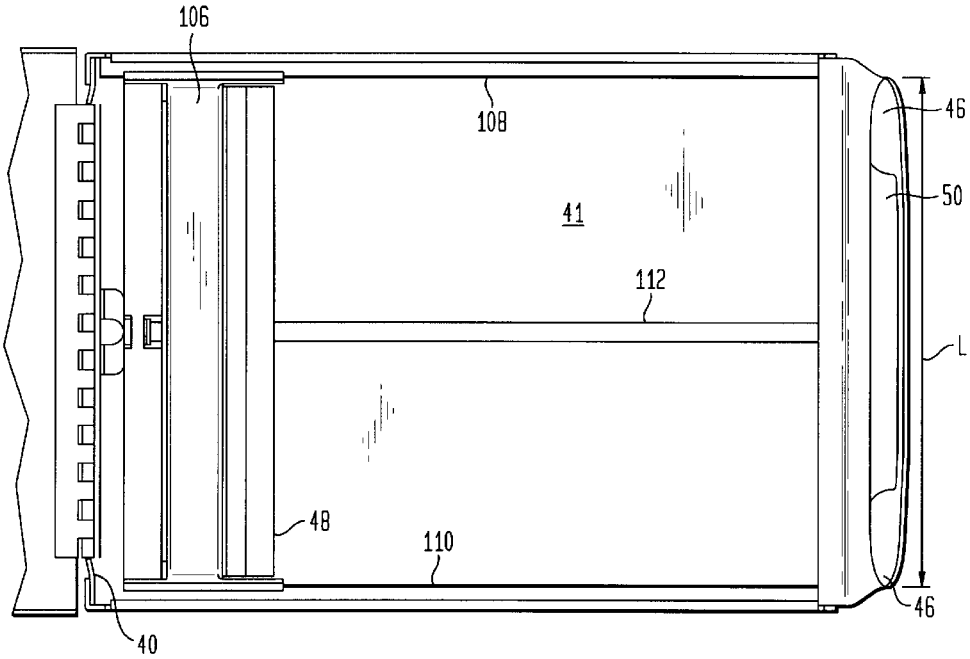
FIG. 7 is a top view illustrating a napkin dispenser configured in accordance with the present invention.

A napkin dispenser fitted with an adapter kit of the present invention is shown in FIGS. 2, 3 and 5 through 8. In general, such a napkin dispenser 30 includes an enclosure 32 having a top wall 34, a pair of side walls 36, 38, a back wall 40 and a front wall 42. The internal side of wall 42 is generally referred to as a dispensing wall 44 herein. Front wall 42 defines a horizontal dispensing slot 46 having a relatively uniform dispensing width, W, (in an unmodified dispenser) (see FIGS. 7, 8) over a length, L, as is best seen in FIG. 7. Typically length, L, is slightly longer than or slightly shorter than the transverse length, L', of an interfolded napkin being dispensed through slot 46. In conventional devices numerous problems occur due to the fact that the dispensing slot allows a plurality of napkins to be dispensed at one time. In accordance with the present invention it has been found that it is desirable to restrict the dimensions of the dispensing slot as well as alter the geometry of the internal dispensing wall 44 and a provide a specially configured pressure plate 48 on the pressure carriage as described in more detail below. That is to say, a conventional napkin dispenser may be fitted with various parts described herein to achieve the desired performance of the napkin dispenser. Alternatively, the napkin dispenser could be constructed ab initio of the described geometry.

Figure 3:
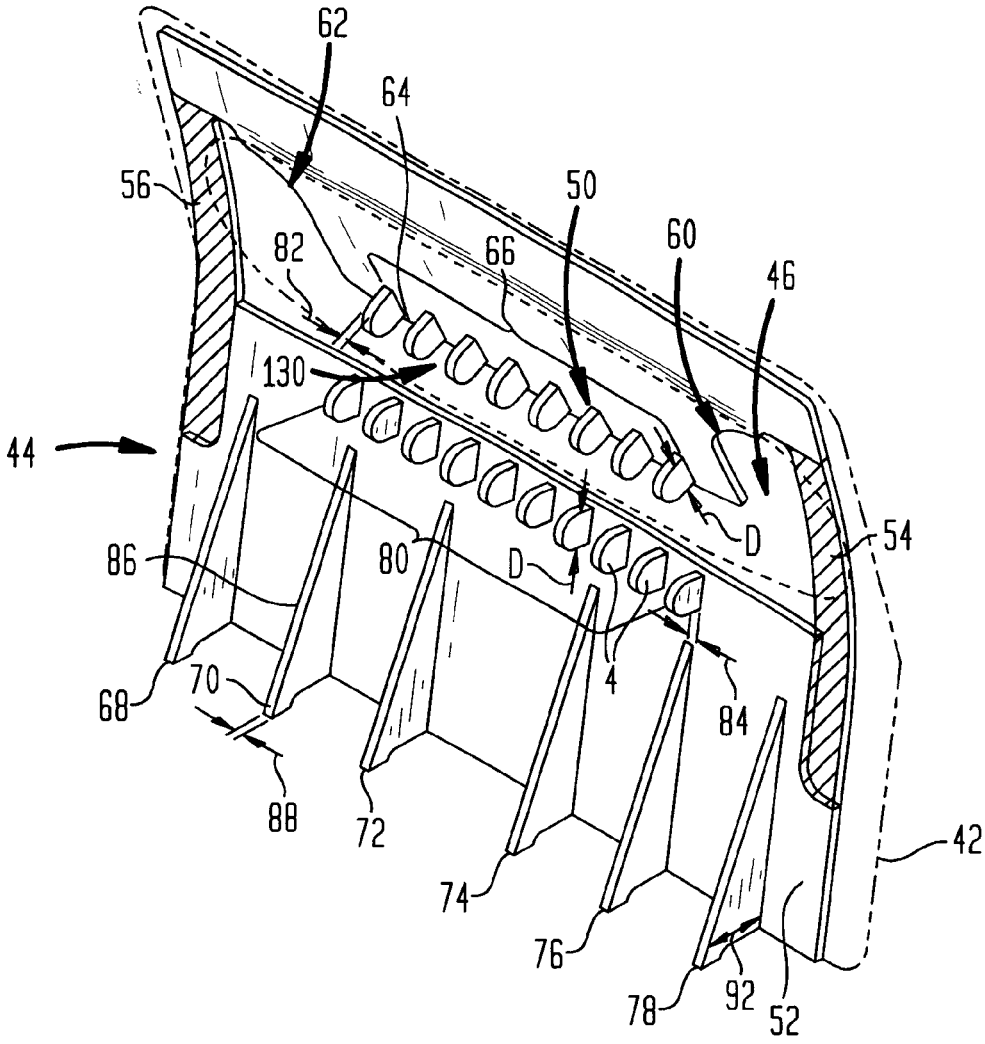
FIG. 3 is a partial view in perspective and phantom lines of the dispensing wall of a napkin dispenser fitted with the adapter kit of the present invention showing guide ridges, friction tabs, a tongue, and some curl limiting tabs about a dispensing aperture of a napkin dispenser.

Referring specifically to FIG. 3, there is shown in perspective a tongue 50 and a lower pressure member 52 for mounting on the interior of front wall 42 to define the internal dispensing wall 44. The conventional dispenser wall is shown in dashed lines. Tongue 50 and pressure member 52 may be separate parts as shown in the diagram or it could be manufactured as a unitary plate as indicated by the shaded areas at 54 and 56. That is to say, separate pieces could be injection molded, for example, or the piece could be molded as a single part if so desired. In any event, the adapter plate or plates may be attached to the interior of wall 42 by adhesives (indicated at 58 on FIG. 6) or by any other suitable means such as rivets or the like. Pressure member 52 and tongue 50 are suitably formed of plastic or other readily formed material. Relatively amorphous plastics such as polycarbonate and the like are particularly preferred.

Tongue 50 is generally rectangular and configured to be mounted about the upper portion of dispensing slot 46. In a typical napkin dispenser dispensing slot 46 may be elevated from the bottom of the dispenser a height of about 3 or 4 inches and below the top wall 34 by about an inch or so. Tongue 50 is further provided with cut away portions 60, 62 to allow for open areas at the terminal portions of the dispensing aperture as shown in the various diagrams of FIGS. 2, 3 and 5 through 8 so that it is possible to reach into the dispenser and withdraw a free edge of a napkin if, for some reason, one is not presented when the prior napkin is withdrawn. Tongue 50 is further provided with a central restrictor portion 64 which projects into slot 46 and substantially narrows the dispensing width about the central portion of the dispensing aperture over the major portion (more than about 50%) of its length, L, as is shown in the various figures. Also provided on tongue 50 are a plurality of friction tabs which operate to limit bunching of napkins through the aperture. Any suitable number of friction tabs 66 may be included which are configured as shown to project substantially perpendicularly from the surface of tongue 50 inwardly into the enclosure from the upper lip of the dispensing slot and frictionally engage the napkins to limit bulge through the slot as shown in the various diagrams.

Figure 2:
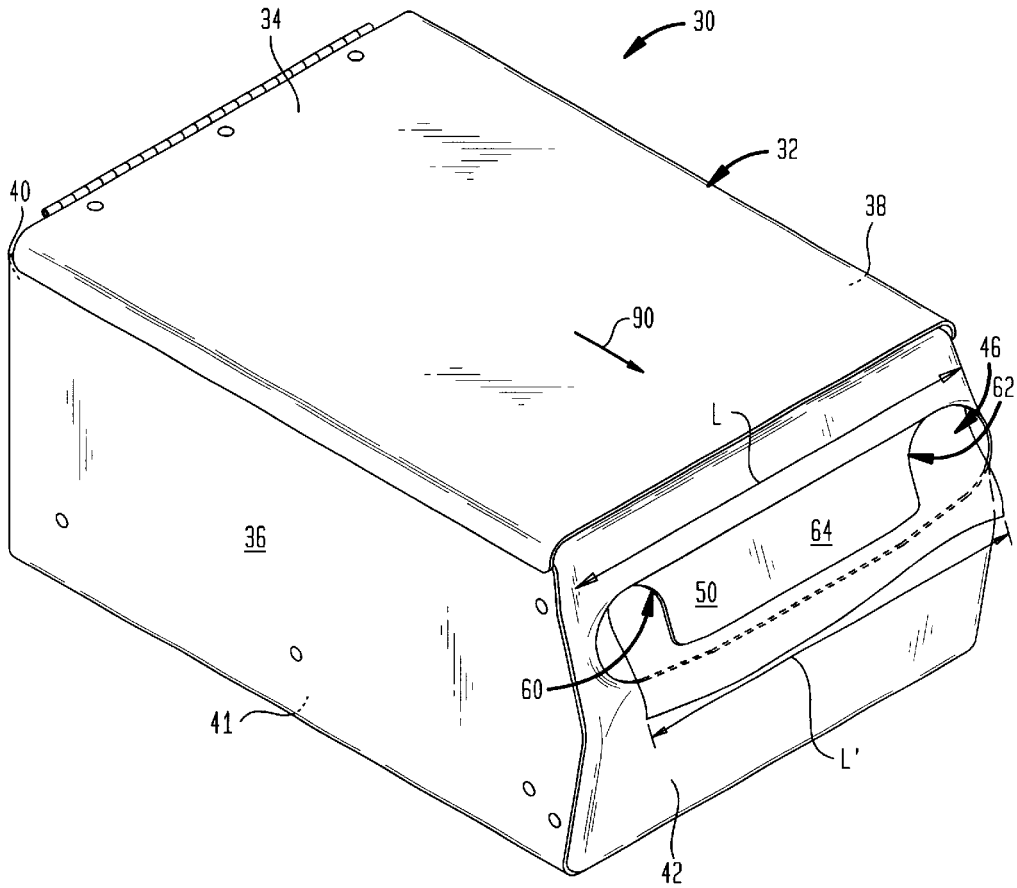
FIG. 2 is a view in perspective of a napkin dispenser fitted with an adapter kit of the present invention.

Lower pressure member 52 is likewise adhesively mounted on the inner surface of front wall 42. Pressure member 52 is generally rectangular in shape and includes a plurality of orienting ridges 68–78 as well as a plurality of curl limiting tabs 80. Curl limiting tabs 80 and friction tabs 66 are generally disc shaped, that is to say, semicircular disc shaped and have a diameter D of typically of from about ¼ to about ½ inch. The friction surface of tabs 66 and 80 generally has a width indicated at 82, 84 of from about 1/16 inch to about ¼ inch and typically about ⅛ of an inch. Likewise a friction surface 86 of orienting ridge 70 has a width 88 of from about 1/16 of an inch to about ¼ inch. In general, the friction surfaces of the orienting ridges, the friction tabs, and the curl limiting tabs are those surfaces which project inwardly with respect to dispensing wall 44 and frictionally engage the napkins, generally perpendicular to the dispensing direction indicated at 90 (FIGS. 2, 6). In general, orienting ridges 68–78 are triangular in shape and project progressively further into the enclosure towards the bottom of the napkin dispenser as will be appreciated from FIGS. 3 and 6. In general, the triangular orienting ridges project inwardly into their enclosure a distance 92 from wall 44 of from about ¼ inch to about 1 inch. As noted hereinabove, a napkin dispenser suited for fitting with an adapter kit of the present invention generally includes a dispensing wall provided with a dispensing aperture and a pressure carriage opposing the dispensing wall.

Figure 4:
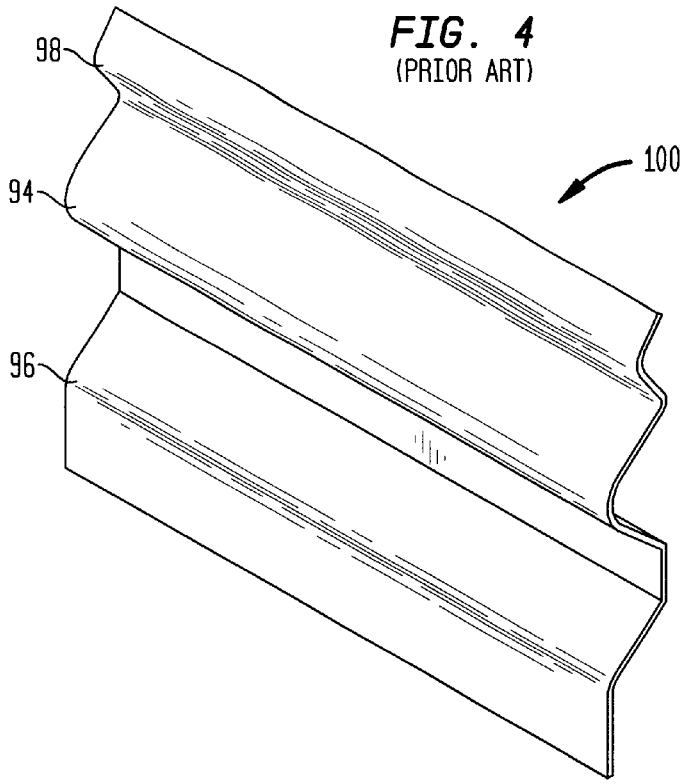
FIG. 4 (PRIOR ART)
FIG. 4 is a view in perspective of a conventional pressure plate used on a spring biased napkin dispenser.

There are shown in FIGS. 4 and 5 pressure plates for mounting on a pressure carriage opposed to the dispensing wall of the napkin dispenser. FIG. 4 is generally a conventional pressure plate for mounting on the pressure carriage. The conventional pressure plate comprises a pair of pressure ribs 94, 96 which are adapted to engage the napkin stack and exert concentrated pressure about the respective upper and lower portions of the stack in order to facilitate napkin dispensing. Further provided is an upper rib 98 for strength which is generally of lesser dimensions and has as its primary function to impart rigidity to pressure plate 100. It has been found in accordance with the present invention that it is preferable to eliminate or substantially reduce the lower pressure rib, such as pressure rib 96 and provide a preferably planar lower portion 102 of a pressure plate 48 and provide only a single pressure rib 105 for mounting in the napkin dispenser. There may also be provided a rib 104 to impart rigidity to pressure plate 48 if so desired.

As will be appreciated from the discussion which follows, pressure plate 48 has a portion such as planar portion 102 in facing relationship to pressure member 52 which is mounted on the inner surface of wall 42 and thus makes up the lower portion of dispensing wall 44. On the other hand, pressure rib 105 is in spaced facing relationship with the upper portion of dispensing wall 44 and provides additional pressure on the stack. Without intending to be bound by any theory, it is believed that the offset pressure members i.e., pressure member 52 and 105 in the inventive design facilitate the reduced curl or curl free dispensing of napkins.

In general, pressure rib 105 projects towards the dispenser wall closer than the lower portion 102 a distance of anywhere from about ½ to about 1 inch closer to dispensing wall 42 than lower portion 102. Conceivably, one could invert the design in some embodiments and place a pressure member on the upper portion of wall 44 and a pressure member on the lower portion of plate 48; the important feature being that the pressure members are offset from one another.

Figure 8:
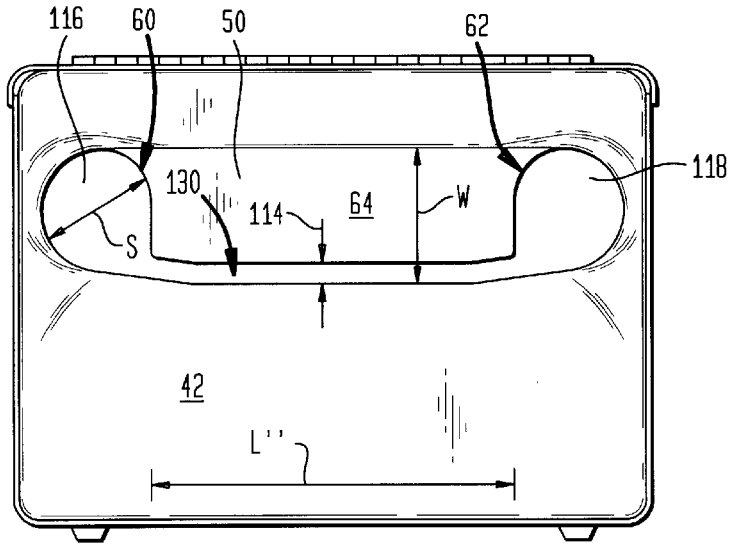
FIG. 8 is a front view illustrating a napkin dispenser fitted with a tongue about the dispensing aperture in accordance with the present invention.

Further details of a suitably constructed or adapted napkin dispenser are appreciated from FIGS. 6 through 8. FIG. 6 is a view in elevation and section along the centerline of a napkin dispenser as shown in FIG. 2 fitted with the adapter kit i.e., tongue 50, pressure member 52, and pressure plate 48. Pressure plate 48 is mounted on a pressure carriage 106 which, in turn, is slidably mounted on a pair of mounting rails 108 and 110. Carriage 106 further includes biasing means in the form of spring 112 which is coiled in the carriage and urges carriage 106 in dispensing direction 90. That is to say, as napkins are withdrawn from the napkin dispenser, the carriage which is spring loaded in the dispensing direction advances the stack to the dispensing aperture. As the napkins are advanced, they frictionally engage the friction tabs 66 as well as the anti-curling tabs indicated at 80 and the guide ridges, such as ridge 72 shown in FIG. 6.

FIG. 7 is a top view wherein the top wall (which is hinged to back wall 40) is raised such that one may see the pressure carriage 106 as well as pressure plate 48 and spring 112 as well as mounting rails 108 and 110. It will be appreciated from FIG. 7 that the dispensing aperture is generally of a length, L, whereas napkins dispensed through the aperture are generally of a length, L', (sometimes referred to herein as the transverse dimension of the napkin, see FIG. 2) which is typically slightly less than the width of the dispensing aperture. Tongue 50 protrudes into slot 46 and restricts the center portion of the slot such that the dispensing of napkins is controlled. The various dimensions are perhaps best appreciated from configuration of FIGS. 2, 7 and 8.

FIG. 8 is a front view of a napkin dispenser fitted with the inventive adapter kit. It will be appreciated from FIG. 8 in particular that the central portion of the dispensing aperture has been restricted by the tongue over a length, L", to have a relatively small aperture width 114. Likewise, there are defined a pair of relatively open areas 116, 118 which are, of course, defined by cut away portion 60, 62 of tongue 50. The central portion of the restricted aperture width typically spans more than about 50 percent of the transverse dimension of an interfolded napkin being dispensed therethrough. In other words, length, L", is typically at least about 50 percent of the length, L', and more preferably is at least about 70 percent of the length, L'. The width 114 of the narrowed central portion of the dispensing slot is typically of from about 1/16 inch to about ⅞ inch with from about ⅛ inch to about ⅞ inch being typical as noted above. Preferably, the narrowed central portion of the dispensing slot is located near the horizontal centerline of the napkin stack. The unmodified width of a dispensing slot i.e., that of a conventional dispenser width, W, as shown in FIG. 8 may be an inch or more.

It is desirable in any event to provide for open areas at the terminal portions of the dispensing slot such as open areas 116 and 118 which have a span, S, of typically greater than about ½ inch. Open area spans on the terminal portion of the dispensing slot are desirably about an inch or more. The reason that the open areas are desirable is that on occasion an edge of an interfolded napkin will not be advanced by the previously withdrawn napkin and it will become necessary for a consumer to restart the stack. Thus, there is desirably a mechanism whereby a consumer with extra effort can manually withdraw a napkin from the dispenser even though no napkin edge is presented through the aperture. The span of the open area at the terminal portion of the dispensing slot may be thought of as the minimum dimension at the terminal portion that a user seeking to extract napkins from the dispenser will encounter. More generally, the "span" of an open area of the dispensing area may be thought of as the minimum distance across the open area through the center of the open area as shown in FIGS. 8 and 8A, labeled S.

Figure 8A:
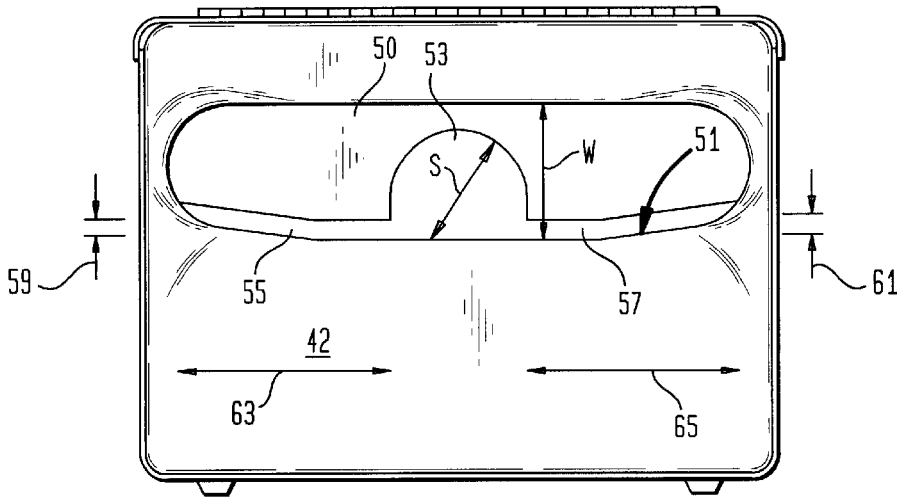
FIG. 8A is a front view illustrating a napkin dispenser fitted with an alternatively designed tongue about the dispensing aperture in accordance with the present invention.

In FIG. 8A there is shown a front view of a napkin dispenser fitted with an alternate embodiment of the inventive adapter kit configured to define an open area in the central region of the dispensing slot. Generally speaking, the dispensing aperture includes an open area in its central region and a plurality of slit segments defining narrow portions on either side of the central opening as shown. Referring specifically to FIG. 8A, a tongue 50 inserted into the slot of a napkin dispenser having a dispensing slot of width, W, defines generally a narrow elongated dispensing aperture 51 with a centrally located open area 53 having a span, S, and two narrow slit portions 55, 57 having narrow opening widths 59, 61 extending over lateral distances 63, 65. Typically, widths 59, 61 are ⅛ up to ⅞ (the same as similar narrow openings in other embodiments) whereas the span, S, of the central opening is up to 1". Lateral distances 63, 65 are collectively at least about 50 percent of the transverse length, L', of a napkin being dispensed in most cases and preferably at least about 70 percent or so of the transverse length of a napkin being dispensed.

It will be appreciated that a stack of napkins indicated at 125 in FIG. 6 will be advanced toward aperture 130 as napkins are withdrawn and that aperture 130 is defined in part by tongue 50 and defined in part by dispensing wall 44 which of course includes the terminal portions of slot 46.

Figure 9:
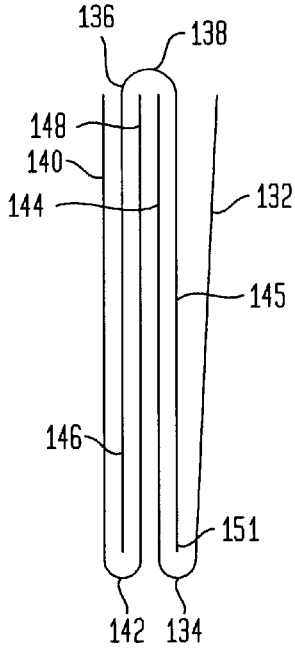
FIG. 9 is a schematic diagram illustrating the arrangement of sheets in a single fold inter-folded napkin stack.
Figure 10:
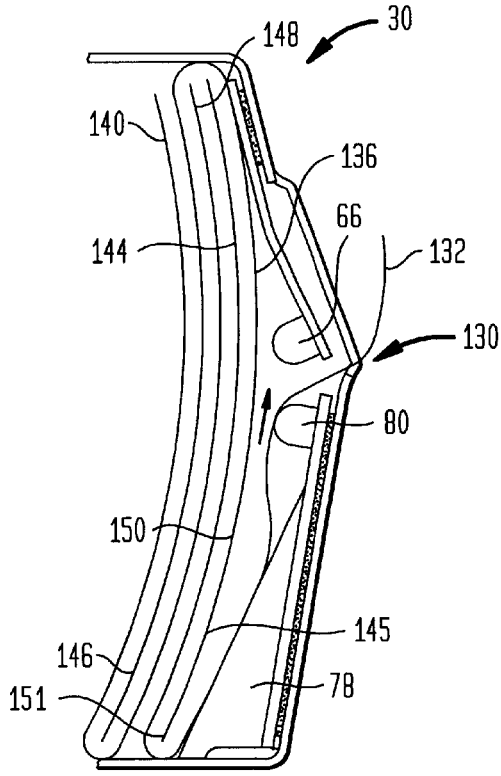
FIG. 10 is a schematic diagram showing the operation of a napkin dispenser configured in accordance with the present invention and in particular the operation of the lower orienting ridges, the curl limiting tabs, and the friction tabs of the present invention.

Thus configured, the inventive napkin dispenser is particularly suited for dispensing interfolded napkins and particularly single fold napkins which may have, if so desired, a basis weight of from about 10 pounds/3000 square foot ream to about 30 pounds/3000 square foot ream. Such napkins are in some cases single fold napkins which generally have the features seen in FIGS. 9 and 10. FIG. 9 is a schematic diagram showing the profile of a portion of a stack of single-fold interfolded napkins. A first napkin 132 has a single fold about its central portion 134, while a second napkin 136 has a fold about its central portion 138 and a third napkin 140 has another fold 142 about its central portion. Napkin 132 has an interleaved portion 144; napkin 136 has interleaved portions 145,146 and napkin 140 has an interleaved portion 148. Napkin 136 also has a "free" edge 151 of interleaved portion 145. In FIG. 10, napkin 132 is shown being withdrawn from the inventive dispenser such that edge 151 of napkin 136 will follow napkin 132 and be the next edge of a napkin to be presented through aperture 130. That is to say, free edge 151 is presented since napkin 136 will be the next napkin to be dispensed after napkin 132.

Without intending to be bound by any theory, the various elements of the inventive napkin dispenser are believed to cooperate to limit curling (and excess napkin dispensing) as illustrated schematically in FIG. 10. Here there is shown napkin 132 which is being withdrawn from the inventive napkin dispenser 30. While being withdrawn, napkin 132 engages the plurality of orienting ridges such as ridge 78 which ridges are in facing relationship to the lower portion of the pressure carriage. As napkin 132 is withdrawn, the guide ridges 68–78 operate to help retain free edge 151 of napkin 136 and the interleaved portion 145 of napkin 136 within the fold of napkin 132 and then direct free edge 151 through aperture 130 as napkin 132 is completely withdrawn from the dispenser. Moreover, the triangular shape of the ridge encourages napkin 136 to fold generally about the area indicated at 150 rather than to curl about its lower portion. Likewise, tab 80 limits curling over the lip of dispensing aperture 130 and the plurality of tabs indicated at 66 limit bunching and protruding through the aperture.

While the present invention has been described in detail, various modifications within the spirit and scope of the present invention will be readily apparent to those of skill in the art. The invention is defined in the appended claims.

What is claimed is:

1. A curl reducing adapter kit for a napkin dispenser used for dispensing interfolded napkins including an enclosure with a dispensing wall defining a horizontal dispensing slot about its upper portion and a slidably mounted, biased pressure carriage adapted to advance a stack of napkins in the enclosure toward the dispensing wall, said adapter kit comprising:

(a) tongue means for mounting about said dispensing wall such that said tongue means project into said dispensing slot and narrow said slot over the majority of its length, said tongue means further including a plurality of friction tabs configured to project inwardly into the enclosure from the upper inner lip of said dispensing slot and frictionally engage said napkins to limit bulge through said slot;

(b) a plurality of orienting ridges configured to be disposed about a lower portion of the dispensing wall adapted to frictionally engage said napkin stack to guide said stack and reduce curl;

(c) a plurality of curl limiting tabs configured to be disposed about the lower inner lip of said dispensing slot and project inwardly into the enclosure so as to frictionally engage said stack of napkins.

2. The adapter kit according to claim 1, further comprising a pressure plate for mounting on said pressure carriage in opposed facing relationship to said dispensing wall, said pressure plate being provided with a pressure rib on its upper portion which is configured to project towards said dispensing wall closer than the lower portion of said pressure plate in opposed facing relationship to said dispensing wall.

3. The adapter kit according to claim 2, wherein said pressure rib of said pressure plate is configured to project a distance of from about ½ inch to about 1 inch closer to said dispensing wall than the lower surface of said pressure plate in opposed facing relationship to said dispensing wall.

4. The adapter kit according to claim 1, wherein said tongue means is configured to define a narrow elongated slit about the central portion of said dispensing slot and a pair of open areas about the terminal portions of said dispensing slot.

5. The adapter kit according to claim 4, wherein said terminal portions have an open area span of at least about ½ inch.

6. The adapter kit according to claim 5, wherein the terminal portions have an open area span of at least about ¾ inch.

7. The adapter kit according to claim 6, wherein said terminal portions have an open area span of at least about 1 inch.

8. The adapter kit according to claim 1, wherein said tongue means is configured to define an open area in the central region of the dispensing slot.

9. The adapter kit according to claim 1, wherein the narrowed portion of said dispensing slot spans more than about 50 percent of the transverse dimension of an interfolded napkin being dispensed therethrough.

10. The adaper kit according to claim 9, wherein the narrowed portion of said dispensing slot spans more than about 70 percent of the transverse dimension of an interfolded napkin being dispensed therethrough.

11. The adapter kit according to claim 1, wherein said tongue means are configured to narrow the dispensing slot to have an opening width over the majority of its length of from about 1/16 inch to about ⅞ inch.

12. The adapter kit according to claim 11, wherein said tongue means are configured to narrow the opening width of said dispensing slot over its narrowed portion to have an opening width of from about ⅛ inch to about ⅞ inch.

13. The adapter kit dispenser according to claim 12, wherein said tongue means are configured to narrow the opening width of said dispensing slot over its narrowed portion to have an opening width of from about ⅜ inch to about ⅝ inch.

14. The adapter kit according to claim 1, wherein said plurality of friction tabs on said tongue means are generally semicircular disc-shaped.

15. The adapter kit according to claim 14, wherein said friction tabs have a diameter of from about ¼ inch to about ½ inch.

16. The adapter kit according to claim 14, wherein said plurality of friction tabs on said tongue means includes from about 6 to about 10 friction tabs.

17. The adapter kit according to claim 1, wherein said friction tabs on said tongue means have a friction surface width of from about 1/16 inch to about 1/4 inch.

18. The adapter kit according to claim 1, wherein said plurality of orienting ridges, comprises a plurality of triangular-shaped ribs which project progressively further into said enclosure toward the base of said dispensing wall.

19. The adapter kit according to claim 18, wherein said triangular orienting ridges project inwardly into said enclosure at their base a distance of from about 1/4 inch to about 1 inch.

20. The adapter kit according to claim 1, wherein said orienting ridges have a friction surface of a width of from about 1/16 inch to about 1/4 inch.

21. The adapter kit according to claim 1, comprising from about 4 to about 8 orienting ridges configured to be disposed about the lower portion of the dispensing wall.

22. The adapter kit according to claim 1, wherein said curl limiting tabs on the lower lip of said dispensing aperture are generally semicircular disc-shaped.

23. The adapter kit according to claim 22, wherein said curl limiting tabs have a diameter of from about 1/4 inch to about 1/2 inch.

24. The adapter kit according to claim 1, wherein said plurality of curl limiting tabs comprises from about 8 to about 12 curl limiting tabs.

25. The adapter kit according to claim 1, wherein said curl limiting tabs have a friction surface width of from about 1/16 inch to about 1/4 inch.

26. A curl reducing adapter kit for a napkin dispenser used for dispensing interfolded napkins including an enclosure with a dispensing wall defining a horizontal dispensing slot about its upper portion and a slidably mounted, biased pressure carriage adapted to advance a stack of napkins in the enclosure toward the dispensing wall, said adapter kit comprising:

(a) tongue means for mounting about said dispensing wall such that said tongue means project into said dispensing slot and narrow said slot about its central portion, said tongue means further including a plurality of friction tabs configured to project inwardly into the enclosure from the upper inner lip of said dispensing slot and frictionally engage said napkins to limit bulge through said slot;

(b) a plurality of orienting ridges configured to be disposed about a lower portion of the dispensing wall adapted to frictionally engage said napkin stack to guide said stack and reduce curl;

(c) a plurality of curl limiting tabs configured to be disposed about the lower inner lip of said dispensing slot and project inwardly into the enclosure so as to frictionally engage said stack of napkins.

27. The adapter kit according to claim 6, further comprising a pressure plate for mounting on said pressure carriage in opposed facing relationship to said dispensing wall, said pressure plate being provided with a pressure rib on its upper portion which is configured to project towards said dispensing wall closer than the lower portion of said pressure plate in opposed facing relationship to said dispensing wall.

28. The adapter kit according to claim 27 wherein said pressure rib of said pressure plate is configured to project a distance of from about 1/2 inch to about 1 inch closer to said dispensing wall than the lower surface of said pressure plate in opposed facing relationship to said dispensing wall.

29. The adapter kit according to claim 26, wherein said narrowed central portion of said dispensing slot spans more than about 50 percent of the transverse dimension of an interfolded napkin being dispensed therethrough.

30. The napkin dispenser according to claim 29, wherein said narrowed central portion of said dispensing slot spans more than about 70 percent of the transverse dimension of an interfolded napkin being dispensed therethrough.

31. The adapter kit according to claim 26, wherein said tongue means are configured to narrow the dispensing slot to have an opening width over the majority of its length of from about 1/16 inch to about 7/8 inch.

32. The adapter kit according to claim 31, wherein said tongue means are configured to define the opening width of said dispensing slot about its central portion such that it has an opening width of from about 1/8 inch to about 7/8 inch.

33. The napkin dispenser according to claim 32, wherein said tongue means are configured to define an opening width about the central portion of said dispensing slot to have a width of from about 3/8 inch to about 5/8 inch.

34. A napkin dispenser for dispensing a stack of interfolded napkins while reducing curling along edges thereof comprising:

(a) an enclosure with a dispensing wall having upper and lower portions provided with an elongated dispensing aperture extending across the dispensing wall between said upper and lower portions thereof, said dispensing wall being further provided with a pressure exerting member projecting inwardly into the interior of said enclosure along an edge portion of one of said upper and lower portions of said dispensing wall;

(b) a pressure carriage slideably mounted in said enclosure having a pressure plate in an opposed facing relationship to said dispensing wall, said pressure plate of said pressure carriage being provided with a pressure rib opposing the portion of the dispensing wall distal to said pressure exerting member of said dispensing wall; and (c) biasing means for urging said pressure carriage towards the dispensing wall, said enclosure and pressure carriage being configured to receive said stack of interfolded napkins between said dispensing wall and said pressure plate of said pressure carriage, such that the napkins are engaged by the pressure exerting member of the dispensing wall and the pressure rib of the pressure plate and wherein the biasing means are operative to advance the stack of napkins toward the dispensing wall as napkins are withdrawn from said dispenser.

35. The napkin dispenser according to claim 34, wherein said dispensing aperture has a narrow, elongated slit about its central portion and at least one open area about a terminal portion thereof.

36. The napkin dispenser according to claim 35, wherein a plurality of friction tabs are disposed about an upper lip of said dispensing aperture and project inwardly into said enclosure and are configured to engage said stack of interfolded napkins.

37. The napkin dispenser according to claim 36, wherein there is further provided a plurality of curl limiting tabs disposed about a lower lip of said dispensing aperture that project inwardly into said enclosure and are configured to frictionally engage said stack of interfolded napkins.

38. The napkin dispenser according to claim 37, wherein said friction tabs and said curl limiting tabs are generally semicircular disc-shaped and said pressure exerting member of said dispensing wall comprises a plurality of triangular orienting ridges which project progressively further into the interior of said napkin dispenser at the lower portions of said dispensing wall.

39. The napkin dispenser according to claim 34, wherein the dispensing aperture includes an open area in its central region and a plurality of slit segments defining a narrow portion of the dispensing aperture on either side of said open area in the central region.

40. A napkin dispenser for dispensing a stack of interfolded napkins while reducing curling along the edges thereof comprising:

(a) an enclosure with a dispensing wall provided with an elongated dispensing aperture extending across the dispensing wall dividing it into upper and lower portions, wherein the lower portion of the dispensing wall is larger than the upper portion of the dispensing wall and is further provided with a plurality of pressure exerting ribs extending inwardly into said enclosure from the lower portion of the dispensing wall, as well as a plurality of friction tabs about the upper edge of said dispensing aperture and a plurality of curl limiting tabs about the lower edge of the dispensing aperture, said tabs extending inwardly into said enclosure;

(b) a pressure carriage slidably mounted in said enclosure having a pressure plate in an opposed facing relationship to said dispensing wall, said pressure plate being provided with an upper pressure rib in opposed facing relationship to said upper portion of said dispensing wall and a lower portion in opposed facing relationship to said lower portion of said dispensing wall; and (c) biasing means for urging said pressure carriage towards the dispensing wall, said enclosure and said pressure carriage being configured to receive said stack of interfolded napkins between said dispensing wall and said pressure plate of said pressure carriage such that the napkins are engaged by the plurality of pressure exerting ribs of the dispensing wall, the plurality of friction tabs and curl limiting tabs of the dispensing wall and the pressure rib of the pressure carriage and wherein the biasing means operate to advance the stack of interfolded napkins toward the dispensing wall as napkins are withdrawn from said dispensing aperture.

41. The napkin dispenser according to claim 40, wherein said dispensing aperture defines a narrow elongated slit about its central portion and a pair of open areas about its terminal portion.

42. The napkin dispenser according to claim 41, wherein said narrow elongated slit spans more than about 50 percent of the transverse dimension of an interfolded napkin being dispensed therethrough.

43. The napkin dispenser according to claim 42, wherein said narrow elongated slit spans more than about 70 percent of the transverse dimension of an interfolded napkin being dispensed therethrough.

44. The napkin dispenser according to claim 42, wherein said narrow elongated slit has an opening width of from about 1/16 inch to about 7/8 inch.

45. The napkin dispenser according to claim 44, wherein said narrow elongated slit has an opening width of from about 1/8 inch to about 7/8 inch.

46. The napkin dispenser according to claim 45, wherein said narrow elongated slit has an opening width of from about 3/8 inch to about 5/8 inch.

47. The napkin dispenser according to claim 41, wherein said terminal portions have an open area span of at least about 1/2 inch.

48. The napkin dispenser according to claim 47, wherein said terminal portions of said dispensing aperture have an open area span of at least about 3/4 inch.

49. The napkin dispenser according to claim 48, wherein said terminal portions have an open area span of at least about 1 inch.

50. The napkin dispenser according to claim 40, wherein the dispensing aperture has an open area in its central region and a plurality of slit segments defining narrow portions of the dispensing aperture.

51. The napkin dispenser according to claim 50, wherein the slit segments collectively span more than about 50 percent of the transverse dimension of an interfolded napkin being dispensed therethrough.

52. The napkin dispenser according to claim 51, wherein the slit segments collectively span more than about 70 percent of the transverse dimension of an interfolded napkin being dispensed therethrough.

53. The napkin dispenser according to claim 50, wherein the slit segments of the dispensing aperture have an opening width of from about 1/8" to about 7/8".

54. The napkin dispenser according to claim 53, wherein the slit segments of the dispensing aperture have an opening width of from about 3/8" to about 7/8".

55. The napkin dispenser according to claim 50, wherein the open area in the central region of the dispensing aperture has a central open area span of at least about 1/2".

56. The napkin dispenser according to claim 55, wherein the open area in the central region of the dispensing aperture has a central open area span of at least about 3/4".

57. The napkin dispenser according to claim 56, wherein the open area in the central region of the dispensing aperture has a central open area span of at least about 1".

58. A napkin dispenser for dispensing a stack of interfolded napkins comprising:

(a) an enclosure including a dispensing wall defining generally a narrow elongated dispensing aperture with at least one open area extending over a portion of said dispensing aperture;

(b) a pressure carriage slidably mounted in said enclosure provided with a pressure plate in opposed facing relationship to said dispensing wall;

(c) a plurality of friction tabs about a first inner lip of said dispensing aperture projecting inwardly into said enclosure towards the pressure plate of said pressure carriage for engaging said napkins;

(d) a plurality of curl limiting tabs about a second inner lip of said dispensing aperture projecting inwardly into said enclosure towards the pressure plate of said pressure carriage for engaging said napkins; and (e) biasing means for urging said pressure carriage towards said dispensing wall, said enclosure, pressure carriage and dispensing wall being thereby adapted and configured to receive a stack of interfolded napkins between said pressure plate of said pressure carriage and said dispensing wall and advance the stack towards said dispensing wall as the napkins are withdrawn from said dispenser.

59. The napkin dispenser according to claim 58, wherein said narrow elongated dispensing aperture has a pair of open areas about its terminal portions and a restricted portion in its central region.

60. The napkin dispenser according to claim 59, wherein the restricted portion of the dispensing aperture spans more than about 50 percent of the transverse dimension of an interfolded napkin being dispensed therethrough.

61. The napkin dispenser according to claim 60, wherein the restricted portion of the dispensing aperture spans more than about 70 percent of the transverse dimension of an interfolded napkin being dispensed therethrough.

62. The napkin dispenser according to claim 58, wherein the generally narrow elongated dispensing aperture is divided into at least two restricted segments by at least one open area in the central region of the dispensing aperture.

63. The napkin dispenser according to claim 62, wherein the restricted segments collectively span more than about 50 percent of the transverse dimension of an interfolded napkin being dispensed therethrough.

64. The napkin dispenser according to claim 63, wherein the restricted segments collectively span more than about 70 percent of the transverse dimension of an interfolded napkin being dispensed therethrough.

65. The napkin dispenser according to claim 58, wherein said napkin dispenser is adapted and used for dispensing a stack of single fold napkins.

* * * * *

UNITED STATES PATENT AND TRADEMARK OFFICE

CERTIFICATE OF CORRECTION

PATENT NO. : 6,824,007 B2
DATED : November 30, 2004
INVENTOR(S) : James K. Timmers et al.

It is certified that error appears in the above-identified patent and that said Letters Patent is hereby corrected as shown below:

Column 1,
Line 31, change “Horwilt”, to -- Horwitt --;
Line 46, change “al” to -- al. --;

Column 2,
Line 21, change “towels for example, as are” to -- towels, for example, as --;

Column 3,
Line 12, change “then” to -- than --;
Line 22, change “1/3” to -- 3/4 --;
Lines 25 and 28, change “spans” to -- span --;

Column 6,
Line 28, change “invention: first” to -- invention. First --;
Line 30, change “dispenser this” to -- dispenser. This --;

Column 7,
Line 5, delete the second instance of “of”;
Line 19, delete “with” and insert -- in --;

Column 8,
Line 2, delete the first instance of “a”;

Column 10,
Line 63, insert -- “ -- after “1/8” and insert -- “ -- after “7/8”;

Column 12,
Line 54, delete “dispenser”; and

UNITED STATES PATENT AND TRADEMARK OFFICE

CERTIFICATE OF CORRECTION

PATENT NO. : 6,824,007 B2
DATED : November 30, 2004
INVENTOR(S) : James K. Timmers et al.

It is certified that error appears in the above-identified patent and that said Letters Patent is hereby corrected as shown below:

Column 13,
Line 53, change “6” to -- 26 --.

Signed and Sealed this

Twelfth Day of April, 2005

JON W. DUDAS
*Director of the United States Patent and Trademark Office*